US009404667B2

(12) United States Patent
Tu et al.

(10) Patent No.: US 9,404,667 B2
(45) Date of Patent: Aug. 2, 2016

(54) DETERMINING POWER STEALING CAPABILITY OF A CLIMATE CONTROL SYSTEM CONTROLLER

(71) Applicant: Emerson Electric Co., St. Louis, MO (US)

(72) Inventors: Lihui Tu, Xi'an (CN); Cuikun Chu, Xi'an (CN)

(73) Assignee: Emerson Electric Co., St. Louis, MO (US)

( * ) Notice: Subject to any disclaimer, the term of this patent is extended or adjusted under 35 U.S.C. 154(b) by 465 days.

(21) Appl. No.: 14/066,765

(22) Filed: Oct. 30, 2013

(65) Prior Publication Data

US 2015/0115045 A1 Apr. 30, 2015

(30) Foreign Application Priority Data

Oct. 25, 2013 (CN) ..... 2013 1 0511667

(51) Int. Cl.
*H02J 1/10* (2006.01)
*H02J 3/38* (2006.01)
*F24F 11/00* (2006.01)

(52) U.S. Cl.
CPC ..... *F24F 11/0086* (2013.01)

(58) Field of Classification Search
CPC ..... Y10S 323/906; Y10S 136/293; Y10S 174/17; Y10S 320/21; Y10S 320/28
USPC ..... 307/51
See application file for complete search history.

(56) References Cited

U.S. PATENT DOCUMENTS 8,110,945 B2 * 2/2012 Simard ..... H02M 5/2573 307/51
8,554,376 B1 * 10/2013 Matsuoka ..... H04L 12/2825 236/46 R
2007/0228183 A1 * 10/2007 Kennedy ..... F24F 11/0012 236/1 C
2012/0199660 A1 8/2012 Warren et al.
2013/0173064 A1 * 7/2013 Fadell ..... G05D 23/1902 700/276

(Continued)

FOREIGN PATENT DOCUMENTS

CA 2820477 9/2013

OTHER PUBLICATIONS

Canadian Office Action dated May 19, 2015, issued in co-pending Canadian Application No. 2,832,625 which claims priority to same priority as the instant application, 4 pgs.

*Primary Examiner* — Jared Fureman
*Assistant Examiner* — Esayas Yeshaw
(74) *Attorney, Agent, or Firm* — Harness, Dickey & Pierce, P.L.C.

(57) ABSTRACT

Disclosed are exemplary embodiments of systems and methods for determining a power stealing capability of a climate control system controller. In an exemplary embodiment, a controller for use in a climate control system generally includes a capacitor chargeable by current flowing through an off-mode load of the climate control system. A voltage detect circuit detects a voltage across the capacitor. The controller includes a timer for determining a charge time of the capacitor from a first specific voltage to a second specific voltage based on input from the voltage detect circuit. The controller determines a resistance of the off-mode load based on the charge time and, based on the determined resistance, determines a level of current for power stealing through the off-mode load.

14 Claims, 3 Drawing Sheets

(56) References Cited

U.S. PATENT DOCUMENTS

2013/0193940 A1* 8/2013 Louvel ..... H02M 3/156
323/282
2014/0052300 A1* 2/2014 Matsuoka ..... F24F 11/0086
700/276
2014/0316581 A1* 10/2014 Fadell ..... F24F 11/0009
700/276
2014/0319232 A1* 10/2014 Gourlay ..... F24F 11/0086
236/51
2014/0368036 A1* 12/2014 Houde ..... H02M 1/08
307/31
2015/0204569 A1* 7/2015 Lorenz ..... F24F 11/0086
700/278

* cited by examiner

DETERMINING POWER STEALING CAPABILITY OF A CLIMATE CONTROL SYSTEM CONTROLLER

CROSS-REFERENCE TO RELATED APPLICATION

This application claims the benefit and priority of Chinese Patent of Invention Application No. 201310511667.3, filed Oct. 25, 2013. The entire disclosure of the above application is incorporated herein by reference.

FIELD

The present disclosure generally relates to power stealing in climate control systems, and more particularly (but not exclusively) to determining a power stealing capability of a climate control system controller such as a thermostat.

BACKGROUND

This section provides background information related to the present disclosure which is not necessarily prior art.

Digital thermostats and other climate control system controllers typically have microcomputers and other components that continuously use electrical power. Various thermostats may utilize "off-mode" power stealing to obtain operating power. That is, when a load (e.g., a compressor, fan, or gas valve) in a climate control system has been switched off, power may be stolen from the "off-mode" load circuit to power the thermostat.

SUMMARY

This section provides a general summary of the disclosure, and is not a comprehensive disclosure of its full scope or all of its features.

According to various aspects, exemplary embodiments are disclosed of systems and methods for determining a power stealing capability of a climate control system controller. In an exemplary embodiment, a controller for use in a climate control system generally includes a capacitor chargeable by current flowing through an off-mode load of the climate control system. A voltage detect circuit detects a voltage across the capacitor. The controller includes a timer for determining a charge time of the capacitor from a first specific voltage to a second specific voltage based on input from the voltage detect circuit. The controller determines a resistance of the off-mode load based on the charge time and, based on the determined resistance, determines a level of current for power stealing through the off-mode load.

In another example embodiment, a controller for use in a climate control system includes a power stealing circuit for stealing power from an off-mode load of the climate control system. A capacitor of the controller is chargeable by current flowing through the off-mode load. A voltage detect circuit is provided for detecting voltages across the capacitor, including first and second specific voltages. A timer is configured to determine a charge time of the capacitor from the first specific voltage to the second specific voltage as detected by the voltage detect circuit. The controller determines a resistance of the off-mode load based on the charge time, determines a power stealing capability of the power stealing circuit based on the determined resistance, and adjusts a duty cycle of the controller based on the determined power stealing capability.

Also disclosed are methods that generally include a method of determining a power stealing capability of a controller of a climate control system. A time duration is determined for charging a capacitor of the controller from a first specific voltage to a second specific voltage, where the capacitor receives charge current through an off-mode load of the climate control system. A resistance of the off-mode load is determined based on the time duration. The determined resistance is used to determine a level of current stealing by the controller through the off-mode load.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

The inventors hereof have recognized that amounts of power stolen by power stealing circuits of thermostats or other controllers of climate control systems can vary with load resistance of the climate control system equipment. Accordingly, the inventors have developed and disclose herein exemplary embodiments of controllers and controller-performed methods whereby a load resistance of HVAC equipment may be determined and used to control how much current to pull through that load when the load is in "off" mode. Using the resistance, a thermostat or other controller can adjust, e.g., maximize, the amount of current it pulls through the equipment in the "off" mode, without causing the current to reach a level, e.g., that would activate a relay or other switch and thereby inadvertently cause the equipment to operate.

It should be noted generally that although various example embodiments are described with reference to thermostats, the disclosure is not so limited. Various embodiments are contemplated in relation to other controllers that could determine power stealing capability and/or perform power stealing in climate control systems.

Figure 1:
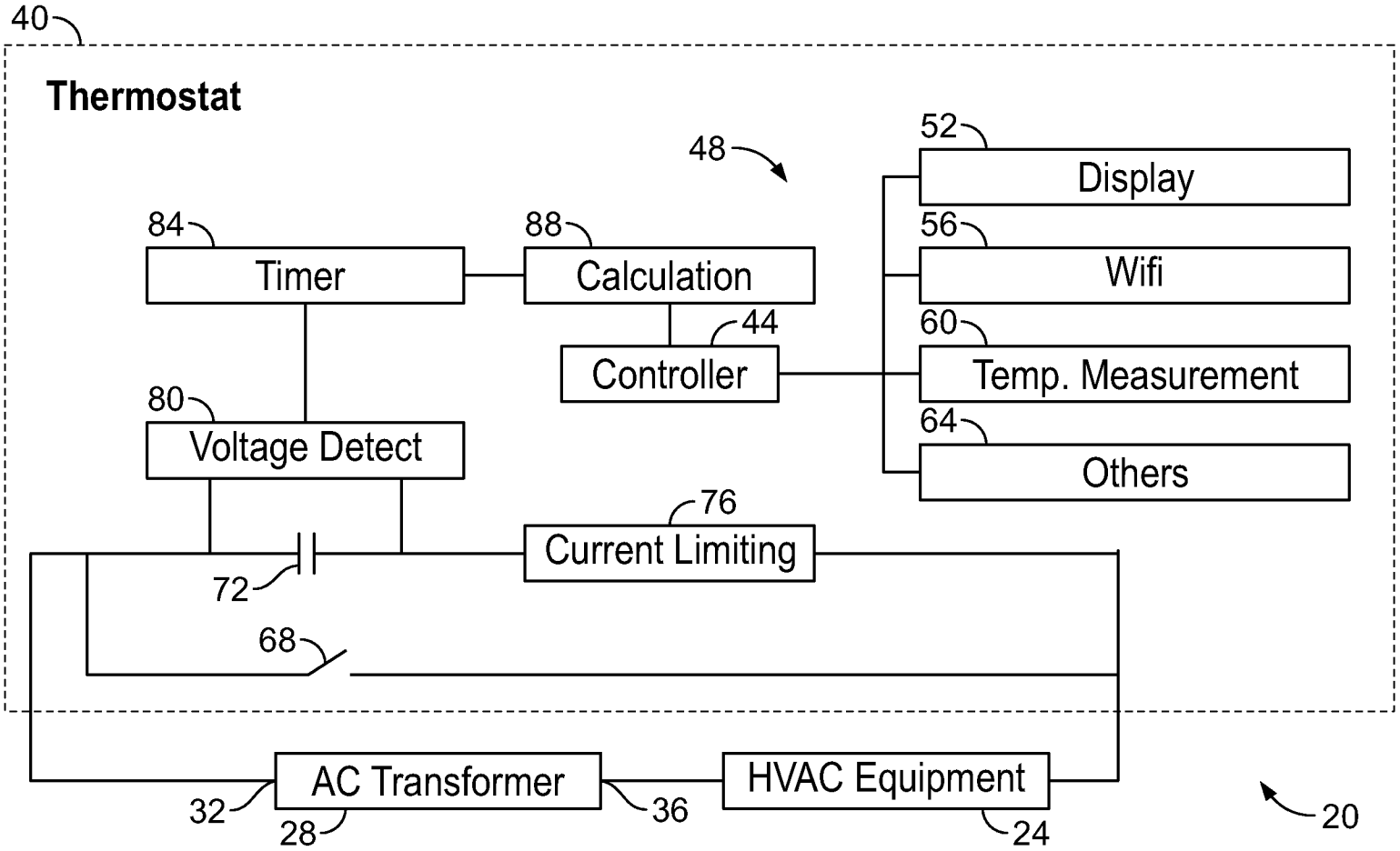
FIG. 1 is a diagram of a climate control system in which a controller is configured to determine power stealing capability in accordance with one example embodiment of the present disclosure.

With reference now to the figures, FIG. 1 illustrates an exemplary embodiment of a climate control system 20 embodying one or more aspects of the present disclosure. As shown in FIG. 1, the climate control system 20 includes heating, ventilation and air conditioning (HVAC) equipment 24 that receives operating power from an AC transformer 28.

It should be noted, however, that other climate control system embodiments may include two transformers for providing power, e.g., respectively to heating and cooling subsystems.

The transformer 28 has a hot (typically 24-volt) side 32 and a common, i.e., neutral, side 36. The HVAC equipment 24 is connected on the common side 36 of the transformer 28 and may include cooling equipment, e.g., a fan and compressor. Additionally or alternatively, the HVAC equipment 24 may include heating equipment, e.g., a furnace gas valve. Other or additional types of equipment could be provided in various climate control system embodiments.

A thermostat 40 is provided for controlling the climate control system 20. The thermostat 40 includes a controller 44 configured to control operation of various thermostat components 48, including, for example, a thermostat display 52, a wireless transceiver 56, and a temperature sensor 60. Other or additional components 64 may include a humidity sensor, other or additional sensors, a thermostat backlight, etc.

The thermostat 40 may activate one or more relays 68 and/or other switching devices(s) to activate all or some of the HVAC equipment 24. A single relay 68 is shown in the example embodiment of FIG. 1 as being operable by the thermostat 40 to switch HVAC equipment 24 on or off. However, it should be understood that more than one relay may be provided in various climate control system embodiments for thermostat control of various HVAC components. In such embodiments, system loads may vary dependent on which components are in operation. Accordingly, embodiments are contemplated in which power stealing may be performed, e.g., alternatively, through more than one climate control system load in the "off" mode, and a power stealing capability may be determined, as described in the present disclosure, as to each load.

Referring again to the example embodiment of FIG. 1, the thermostat 40 utilizes "off-mode" power stealing. When, e.g., the relay 68 is open and the HVAC equipment 24 is switched off, a power stealing circuit (not shown) may obtain power from the transformer 28 for use by the thermostat 40, e.g. in controlling various thermostat components 48. During power stealing, current flows through the HVAC equipment 24 at a level low enough to avoid closing the relay 68. Stolen power may be stored in one or more batteries (not shown) and/or may be used, e.g., to power the thermostat components 48.

In the present example embodiment, the thermostat 40 is configured to determine a load resistance of the HVAC equipment 24. Thus the thermostat 40 is provided with a capacitor 72 that is chargeable by current flowing through the HVAC equipment 24 when the equipment 24 is in the "off" mode. In the present example, current to the capacitor 72 is limited and rectified by a current limiting circuit 76. A voltage detect circuit 80 is provided across the capacitor 72. A timer 84 is connected between the voltage detect circuit 80 and a calculation module 88. The calculation module 88 is in communication with the controller 44 and may be used, e.g., to calculate the load resistance of the HVAC equipment 24 as further described below.

Figure 2:
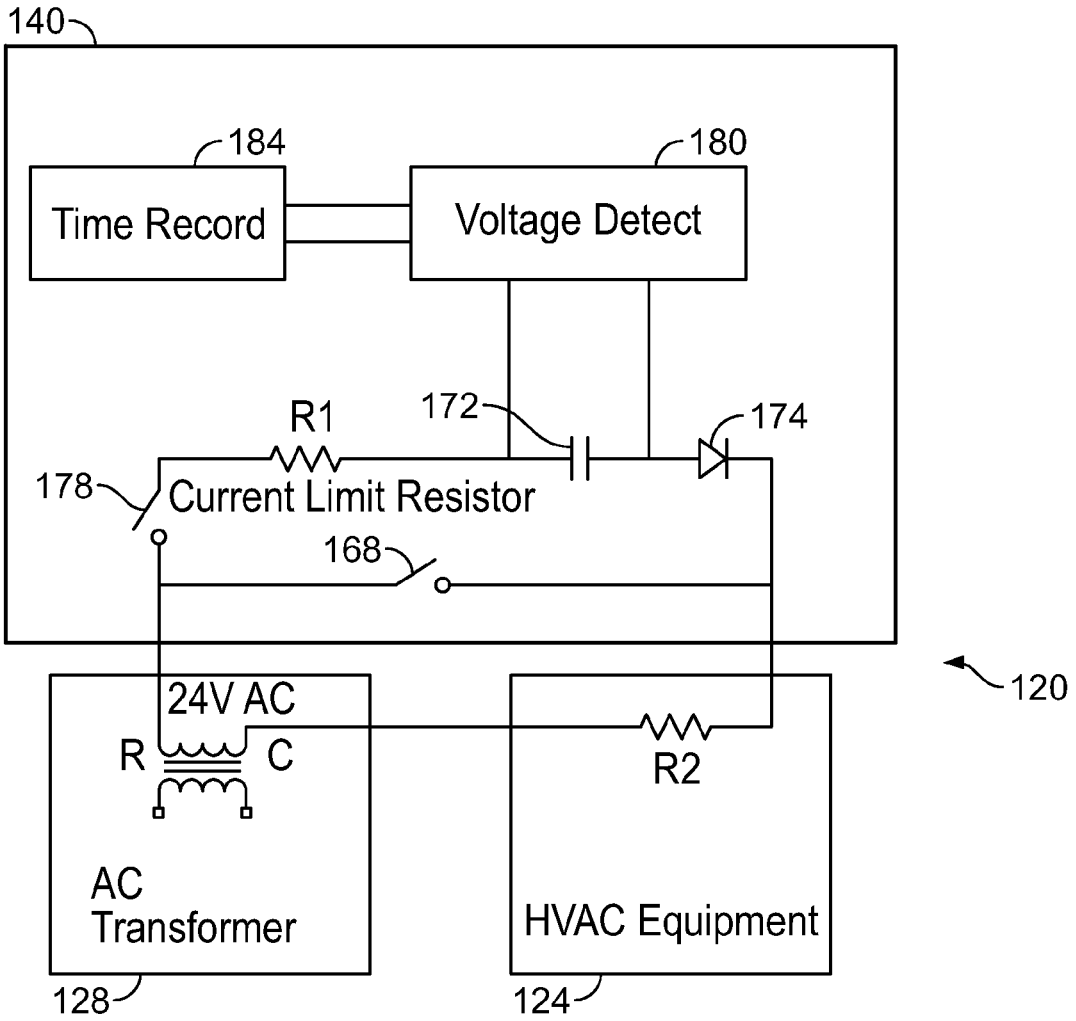
FIG. 2 is a diagram of a climate control system in which a controller is configured to determine power stealing capability in accordance with one example embodiment of the present disclosure.

Another example embodiment of a climate control system is indicated generally in FIG. 2 by reference number 120. The climate control system 120 includes heating, ventilation and air conditioning (HVAC) equipment 124 that receives operating power from a transformer 128. The transformer 128 has a hot (typically 24-volt) "R" side and a common, i.e., neutral, "C" side. The HVAC equipment 124 is connected on the common "C" side of the transformer 128 and has a load resistance represented as a resistor R2. A thermostat 140 is provided for controlling the climate control system 120. The thermostat 140 activates a relay 168 to switch the HVAC equipment 124 between on and "off" modes.

In one example embodiment of the disclosure, the thermostat 140 utilizes "off-mode" power stealing. When, e.g., the relay 168 is open and the HVAC equipment 124 is switched off, a power stealing circuit (not shown) may obtain power from the transformer 128 for use by the thermostat 140 in controlling various thermostat components, e.g., as previously discussed with reference to FIG. 1. During power stealing, current flows through the HVAC equipment 124 at a level low enough to avoid closing the relay 168. Stolen power may be stored in one or more batteries (not shown.)

In the present example embodiment, the thermostat 140 is configured to determine the HVAC equipment load resistance R2, and to use the resistance R2 to determine how much power can be consumed through the power stealing circuit. Thus in the present embodiment, the thermostat 140 includes a capacitor 172 in series with a diode 174, a current limiting resistor R1, and a switch 178. A voltage detect circuit 180 is provided across the capacitor 172 and is connected with a time record circuit 184.

When the thermostat 140 opens the relay 168, the HVAC equipment 124 is switched to the "off" mode. When the relay 168 is open, the thermostat 140 can close the switch 178. Current then flows from the "R" side of the transformer 128 into the thermostat 140, through the HVAC equipment 124, and through the "C" side of the transformer 128. In the thermostat 140, current is converted to DC and flows into the capacitor 172 so that the capacitor 172 becomes charged. The charging speed depends on the load resistance R2 of the HVAC equipment 124, which means generally that different HVAC equipment configurations could require different charge times for charging the capacitor 172 from one specific voltage to another specific voltage.

In the present example embodiment, the voltage detect circuit 180 can sense the voltage on the capacitor 172 and the time record circuit 184 can record a time period over which the capacitor 172 is charged from a specific voltage to another specific voltage. The recorded time period can be used to determine the load resistance R2 of the HVAC equipment 124. In various embodiments, once R2 is known, it can be used to calculate a power stealing capability of the thermostat 140, e.g., a power stealing current I. The power stealing current I can be used to manage the operation of applications on the thermostat 140, e.g., so that battery life can be calculated and controlled, e.g., as further described below.

For example, when the relay 168 is open, the switch 178 can be closed to charge the capacitor 172 from a voltage $V_0$ to a voltage $V_t$ through resistors R1 and R2. The charging time t can be recorded by the time record circuit 184. The HVAC equipment resistance R2 can be calculated, e.g., in accordance with the following equation:

$$V_t = V_0 + (V_1 - V_0) \times (1 - e^{-t/RC})$$

where R=R1+R2, and V1 is a fixed voltage, e.g., a selected voltage across the capacitor 172 (in the present example, 12 volts).

In the present example embodiment, $V_t$, $V_0$, R1 and capacitance C of the capacitor 172 are values that are fixed in the thermostat 140.

The power stealing current I may be obtained in accordance with:

$$V = IR2$$

where V represents voltage across the HVAC equipment load 124.

As previously discussed, a power stealing current I for a given thermostat depends on the resistance of the equipment connected to the thermostat. Power stealing circuit testing may be performed to obtain data, as described above, for constructing a lookup table (LUT) of load resistance values and corresponding current values. In various embodiments of the disclosure, a thermostat includes such a table whereby the thermostat may select a current level appropriate for power stealing.

Figure 3:
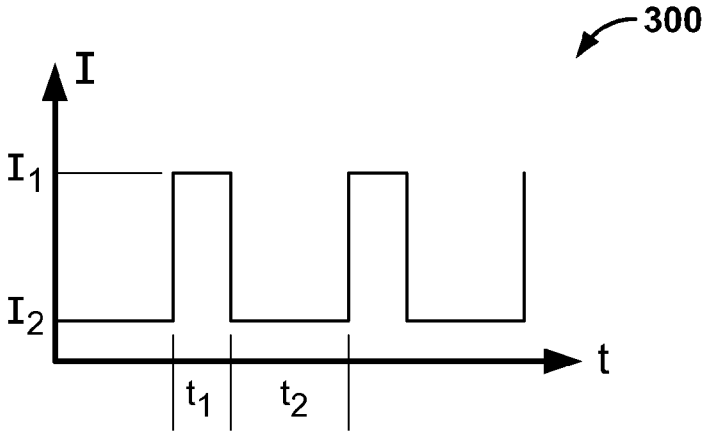
FIG. 3 is a diagram of a duty cycle of a climate control system controller in accordance with one example embodiment of the present disclosure.

In various embodiments, the value obtained for power stealing current I by a given thermostat may be used to control the life of a battery providing power to the thermostat. For example, as shown in FIG. 3, a thermostat may operate in accordance with a duty cycle 300. Over time t, a current $I_1$ (in milliamps) may drain from a battery of the thermostat when the thermostat is operating, and a current $I_2$ (in milliamps) may drain from the battery when the thermostat is not operating. The thermostat alternates between operation for a time period $t_1$ (in seconds) and non-operation for a time period $t_2$ (in seconds). Thus the thermostat operates for $t_1$ seconds, every $(t_1+t_2)$ seconds. A total average current drain from the battery is represented by:

$$(I_2t_1+I_2t_2)/(t_1+t_2)(\text{in milliamps}).$$

The average current drain when power stealing is being performed is represented by:

$$(I_1t_1+I_2t_2)/(t_1+t_2)-I(\text{in milliamps}).$$

Accordingly, where the battery has X milliamp-hours of energy, battery life can be calculated to be:

$$X/[(I_1t_1+I_2t_2)/(t_1+t_2)-I](\text{in hours}).$$

It can be seen that battery life can be controlled by adjusting the duty cycle 300, e.g., by adjusting the time periods $t_1$ and $t_2$.

A capability for controlling battery life through knowledge of power stealing capability can be highly useful, for example, in a thermostat that is wireless-enabled. In order to extend battery life, such a thermostat may determine its wireless operating mode based on how much current can be stolen. Increased availability of stolen current can result, e.g., in faster wireless connections. Capability for control of battery life can also be advantageous, e.g., in a thermostat that has other features that may be switched off to save battery energy. Some thermostats, for example, turn off an LCD display and/or backlight when not in use, in order to save energy—even though enough current could be made available through power stealing. In various embodiments, a thermostat now can determine whether enough stolen current would be available, and can keep a display and/or backlight lit for longer periods, e.g., essentially always lit.

Figure 4:
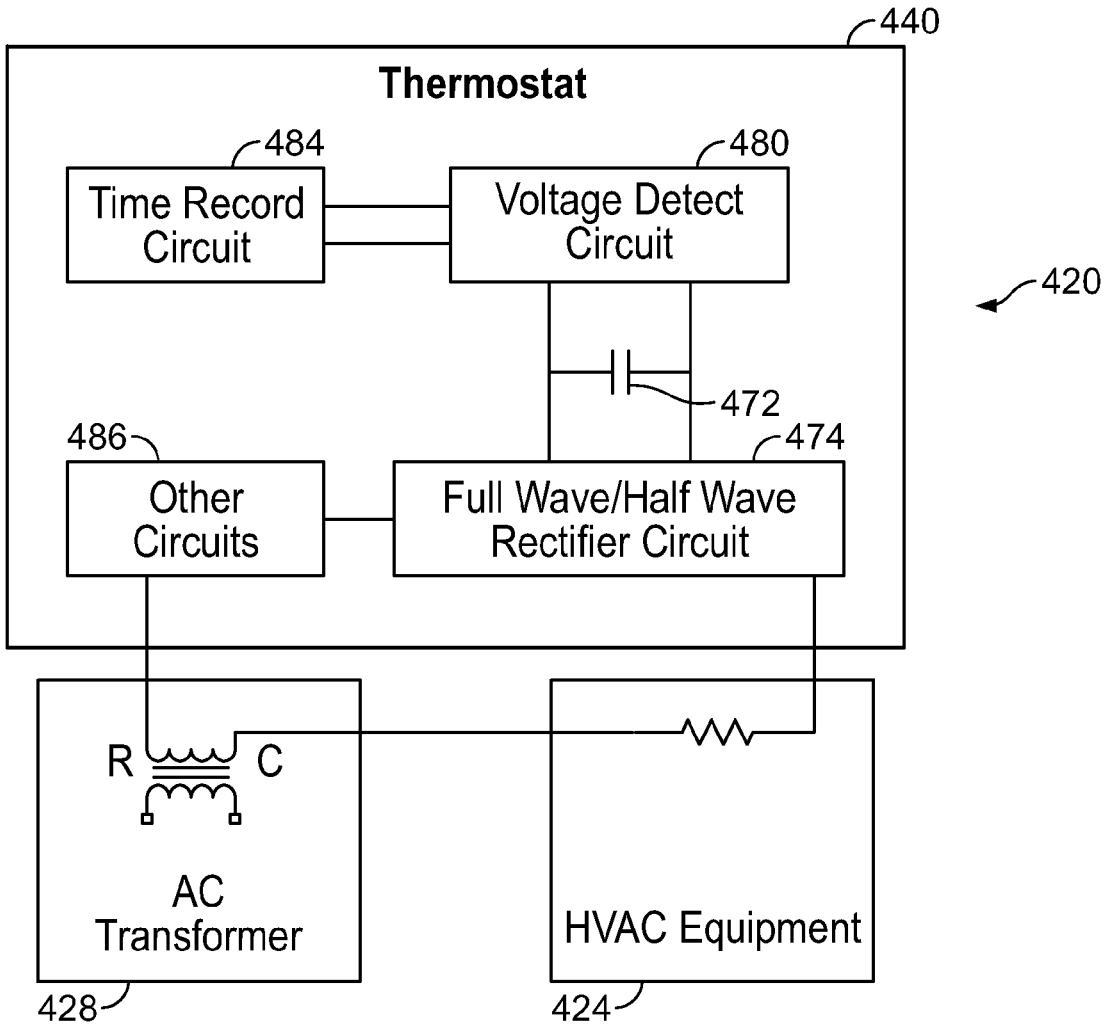
FIG. 4 is a diagram of a climate control system in which a controller is configured to determine power stealing capability in accordance with one example embodiment of the present disclosure.

Another example embodiment of a climate control system is indicated generally in FIG. 4 by reference number 420. The climate control system 420 includes HVAC equipment 424 that receives operating power from a transformer 428. A thermostat 440 is provided for controlling the climate control system 420. As shown in FIG. 4, the HVAC equipment 424 is in the "off" mode. In the present example embodiment, the thermostat 440 includes a capacitor 472 that receives current through a full-wave or half-wave rectifier circuit 474. A voltage detect circuit 480 is provided across the capacitor 472 and is connected with a time record circuit 484. Other circuits 486 of the thermostat 440, which may include, e.g., a power stealing circuit, receive power through the transformer 428.

The foregoing systems and methods make it possible to control battery life in a thermostat or other climate control system controller without having to make frequent measurements of voltage. When the resistance of HVAC equipment through which power stealing is to be performed has been identified, a power stealing capability can be calculated and used to manage operation of the controller. The foregoing systems and methods can be used to provide improved management of power consumption by applications of a thermostat or other controller that receives power through power stealing. Power stealing can be managed with very low power consumption, since very little time (e.g., a few seconds) is needed to perform the foregoing methods, and since an interval over which to measure capacitor charge could be long, e.g., in days. In contrast to methods used in some conventional controllers, there is no need to measure voltage frequently (and thereby to consume energy). In embodiments of the present disclosure, an HVAC load resistance and power stealing capability can be determined and can support management of a thermostat load (including wireless capability, etc.) In various embodiments an actual load resistance can be determined in an "off" mode of the load, and a single value for current stealing can be determined.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an,"

and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A controller for use in a climate control system, the controller comprising:

a capacitor chargeable by current flowing through an off-mode load of the climate control system;

a voltage detect circuit for detecting a voltage across the capacitor; and a timer for determining a charge time of the capacitor from a first specific voltage to a second specific voltage based on input from the voltage detect circuit;

the controller being configured to determine a resistance of the off-mode load based on the charge time and based on the determined resistance, to determine a level of current for power stealing through the off-mode load; and wherein the resistance of the off-mode load is determined in accordance with:

$$V_t = V_0 + (V_1 - V_0) \times (1 - e^{-t/RC})$$

where $V_t$ represents a voltage across the capacitor at a time t, R represents a circuit resistance that includes the resistance of the off-mode load, C represents capacitance of the capacitor, and $V_0$ and $V_1$ represent the first and second specific voltages.

2. The controller of claim 1, wherein the controller is further configured to control the life of a battery providing power to the controller, the controlling performed by adjusting a duty cycle of the controller based on the determined level of current for power stealing.

3. The controller of claim 1, further comprising a power stealing circuit.

4. The controller of claim 1, further comprising a current limiting circuit between the capacitor and the HVAC equipment.

5. The controller of claim 1, wherein the controller is a thermostat.

6. The controller of claim 1, wherein the controller uses the determined resistance and a lookup table to determine the level of current for power stealing.

7. A controller for use in a climate control system, the controller comprising:

a power stealing circuit for stealing power from an off-mode load of the climate control system;

a capacitor chargeable by current flowing through the off-mode load;

a voltage detect circuit for detecting voltages across the capacitor, including first and second specific voltages; and a timer configured to determine a charge time of the capacitor from the first specific voltage to the second specific voltage as detected by the voltage detect circuit;

the controller being configured to:

determine a resistance of the off-mode load based on the charge time;

determine a power stealing capability of the power stealing circuit based on the determined resistance; and adjust a duty cycle of the controller based on the determined power stealing capability; and wherein the resistance of the off-mode load is determined in accordance with:

$$V_t = V_0 + (V_1 - V_0) \times (1 - e^{-t/RC})$$

where $V_t$ represents a voltage across the capacitor at a time t, R represents a circuit resistance that includes the resistance of the off-mode load, C represents capacitance of the capacitor, and $V_0$ and $V_1$ represent the first and second specific voltages.

8. The controller of claim 7, further comprising a current limiting circuit between the capacitor and the HVAC equipment.

9. The controller of claim 7, wherein the controller is a thermostat.

10. The controller of claim 7, wherein the controller uses the determined resistance and a lookup table to determine the level of current for power stealing.

11. A method of determining a power stealing capability of a controller of a climate control system, the method comprising:

determining a time duration for charging a capacitor of the controller from a first specific voltage to a second specific voltage, where the capacitor receives charge current through an off-mode load of the climate control system;

determining a resistance of the off-mode load based on the time duration; and using the determined resistance to determine a level of current stealing by the controller through the off-mode load; and wherein the resistance of the off-mode load is determined in accordance with:

$$V_t = V_0 + (V_1 - V_0) \times (1 - e^{-t/RC})$$

where $V_t$ represents a voltage across the capacitor at a time t, R represents a circuit resistance that includes the resistance of the off-mode load, C represents capacitance of the capacitor, and $V_0$ and $V_1$ represent the first and second specific voltages.

12. The method of claim 11, further comprising adjusting a duty cycle of the controller based on the determined current stealing level, the adjusting performed to control the life of a battery of the controller.

13. The method of claim 11, wherein the controller is a thermostat.

14. The method of claim 11, wherein the controller uses the determined resistance and a lookup table to determine the level of current for power stealing.

* * * * *